United States Patent [19]

Carnielli

[11] Patent Number: 4,753,435

[45] Date of Patent: Jun. 28, 1988

[54] HANDLE-BAR MOTION UNIT FOR EXERCISE BICYCLES

[76] Inventor: Teodoro Carnielli, Via Dante 61, 31029 Vittorio Veneto Treviso, Italy

[21] Appl. No.: 934,622

[22] Filed: Nov. 25, 1986

[30] Foreign Application Priority Data

Feb. 13, 1986 [IT] Italy ..... 19391 A/86

[51] Int. Cl.[4] ..... A63B 21/00

[52] U.S. Cl. ..... 272/73

[58] Field of Search ..... 272/72, 73; 74/571 M, 74/571 L, 575, 551.1, 551.5; 128/25 R

[56] References Cited

U.S. PATENT DOCUMENTS

| | | | |
|---|---|---|---|
| 734,662 | 7/1903 | Blaisdell | 272/73 |
| 1,916,786 | 7/1933 | Elliott | 74/575 |
| 2,565,348 | 8/1951 | Brockman et al. | 272/73 |
| 3,915,159 | 10/1975 | Simjian | 272/73 |

FOREIGN PATENT DOCUMENTS

| | | | |
|---|---|---|---|
| 3517461 | 5/1985 | Fed. Rep. of Germany | 272/73 |
| 453982 | 8/1968 | Switzerland | 272/73 |

*Primary Examiner*—Richard J. Apley
*Assistant Examiner*—S. R. Crow
*Attorney, Agent, or Firm*—Bucknam and Archer

[57] ABSTRACT

A handle-bar motion unit for an exercise bicycle has a gear wheel provided with an eccentric boss and is coupled to a toothed sprocket connected for rotation with the pedal mechanism of an exercise bicycle; the eccentric boss engages in an eccentric hole in a bush rotatably fitted within the big end of a connecting rod connected to the handle-bar column; the ratchet mechanism transmits forward drive and allows relative rotation of the bush and the boss in the reverse direction in order to select an eccentricity position of the big end with respect to the gear to convert the exercise bicycle from a fixed handle-bar condition to one having a reciprocating movement applied to the handle-bars by rotation of the pedals, the conversion being effected simply by back-pedalling by half of one revolution.

1 Claim, 3 Drawing Sheets

HANDLE-BAR MOTION UNIT FOR EXERCISE BICYCLES

BACKGROUND OF THE INVENTION

Many exercise bicycles (also known as static bicycles) provide only for exercising the legs by operating pedals against an adjustable resistance. Some such machines, however, are also provided with means for exercising the arms and upper part of the body. This movement is achieved by making the handle-bars perform a reciprocatory movement which, in practice, is directly driven from the motion of the pedals.

In known such machines an eccentric mechanism is provided, which is connected to the pedals and is connectable, by means of a pin or similar element, to the lower end of the handle-bar support column in such a way as to cause a reciprocating motion of the handle-bars to take place in synchronism with the rotation of the pedals.

If the utiliser does not wish to perform the exercises involved with the upper limbs and the trunk it is possible to disconnect the reciprocating motion drive to leave the handle-bars in a fixed position: this is achieved by uncoupling the eccentric connection, for example by extraction of the pin which makes the connection. This conversion from one type of operation to the other is not, however, very easy to achieve and requires an operation, which whilst being simple, is rather inconvenient and is thus not always voluntarily effected by the utiliser. Such an exercise bicycle is for example known from the Swiss Pat. No. 453,982 in the name of the same Applicant which is herein incorporated by reference.

OBJECTS OF THE INVENTION

The primary object of the present invention is to overcome the above-explained limitation by providing a handle-bar motion unit for an exercise bicycle by means of which coupling or uncoupling of the reciprocating movement of the handle-bars can be effected simply and easily.

Another object of the invention is to provide a handle-bar motion unit which is operable to convert from a static handle-bar system to a moving handle-bar system simply by acting on the pedals without having to perform operations of other type.

A further object of the invention is to provide an exercise bicycle in which, in addition to the reciprocating motion of the handle-bars towards and away from the saddle in the direction which the user is facing, the handle-bars may also be selectively connected to the drive mechanism to perform an arcuate reciprocating motion about an upright axis generally parallel to the support column on which the handle-bars are mounted, thus permitting exercises beneficial for the twisting of the trunk.

A particular object of the invention is to provide a handle-bar motion unit which is easily fitted to a static exercise bicycle of any form and structure.

Another object of the invention is to provide a handle-bar motion unit which, by its particular constructional characteristics, is able to offer the widest guarantees of reliability and safety in use.

A further object of the invention is to provide a handle-bar motion unit which is easily obtainable starting from elements and materials which are commonly available on the market and, moreover, which is competitive from an economic point of view.

SUMMARY OF THE INVENTION

The handle-bar motion unit of the invention includes a gear having an eccentric boss on one face, the gear being coupled to a toothed sprocket connected for rotation with the pedal mechanism, the eccentric boss engaging rotatably within an eccentric bore in a bush rotatable within the big end of a connecting rod the little end of which is connected to the handle-bar stem, there being a ratchet mechanism between the eccentric boss of the gear and the bush so arranged that it transmits rotary motion from the eccentric boss to the bush when rotated in the forward direction and allows relative rotation of the boss and the bush when rotated in the reverse direction, whereby to allow the unit to move from a first operating position in which the big end of the connecting rod is connected eccentrically on the gear to a second working position in which the eccentricity of the boss and that of the bush counteract one another and the big end of the connecting rod is effectively concentric with the gear.

The big end of the connecting rod preferably is formed as a ring within which the bush is received. The ratchet mechanism may thus be caused to rotate with respect to the bush by rotation of the pedal mechanism in the opposite direction from the direction of normal use, that is by back-pedalling, whereby to select a concentric position of the big end loop with respect to the gear with a consequent fixed position of the handle-bars in use, or an eccentric position of the big end loop with respect to the gear, with the consequent transmission of reciprocating movement to the handle-bars themselves upon rotation of the pedal mechanism.

Various other features and advantages of the present invention will become apparent from a study of the following descriptions of a preferred embodiment, in which reference is made to the accompanying drawings, provided purely by way of non-limitative example.

DESCRIPTION OF THE PREFERRED EMBODIMENT

Figure 1:
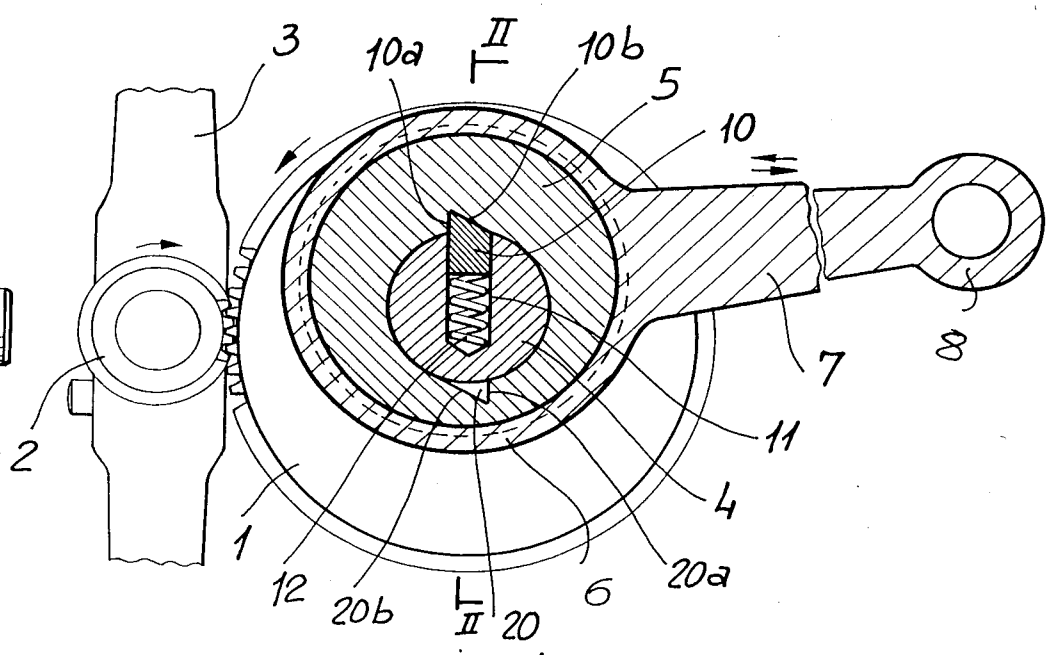
FIG. 1 is a partially sectioned schematic plan view from above of a handle-bar motion mechanism shown in a first operating position.
Figure 2:
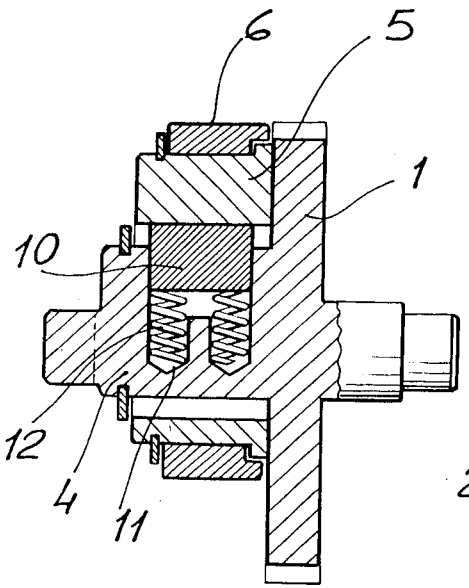
FIG. 2 is a section taken on the line II—II of FIG. 1.

Referring now to the drawings, and particularly to FIG. 1, the exercise bicycle handle-bar motion unit of the invention can be fitted to an exercise bicycle of any shape, (which has not been specifically shown and may consist, for example, of the exercise bicycle disclosed in the mentioned Swiss Pat. No. 453,982 in the name of the same Applicant) and includes a gear 1 which is rotatably supported by the frame (not shown) of the exercise bicycle. The gear 1 is coupled for rotation to a toothed sprocket 2 fitted to the axis of rotation of the pedal mechanism 3 in such a way as to drive the gear 1 to rotate when the pedal mechanism is caused to rotate.

On one of its faces the gear 1 has an eccentric body or boss 4 which is housed within a bush 5 and connected for rotation therewith by a ratchet mechanism which will be described in more detail hereinbelow. The outer periphery of the bush 5 is rotatably coupled to a ring at the big end of a connecting rod 7 the little end of which is connected in a manner known per se to a column (not shown) supporting the exercise bicycle handle-bars (not shown) whereby to obtain oscillation of the handle-bar about a substantially horizontal axis extending transversely of the longitudinal axis of the bicycle frame, that is the axis extending horizontally from front to back in the direction which the user faces when using the machine.

The purpose of the ratchet mechanism is to make it possible to effect conversion of the big end loop 6 from an eccentric position on the gear 1 to a non-eccentric or concentric position, or vice versa, simply by effecting rotation of the pedal mechanism in the opposite sense from the normal direction of operation.

In the illustrated embodiment the ratchet mechanism is constituted by a pawl 10 housed in a radial bore 11 in the eccentric boss 4, and resiliently urged radially outwardly by a compression spring 12 which acts between the pawl 10 and the bottom of the bore 11.

Figure 3:
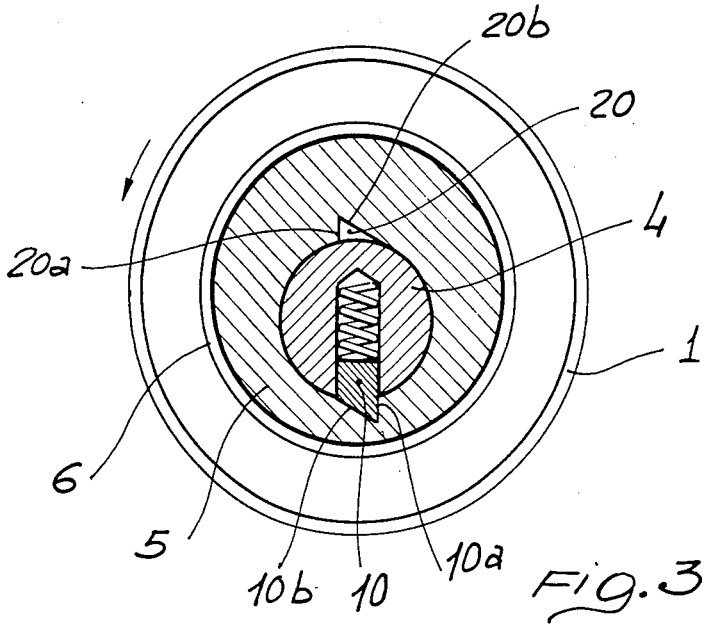
FIG. 3 is a schematic plan view of a part of the unit shown in FIG. 1, in a second operating position.
Figure 4:
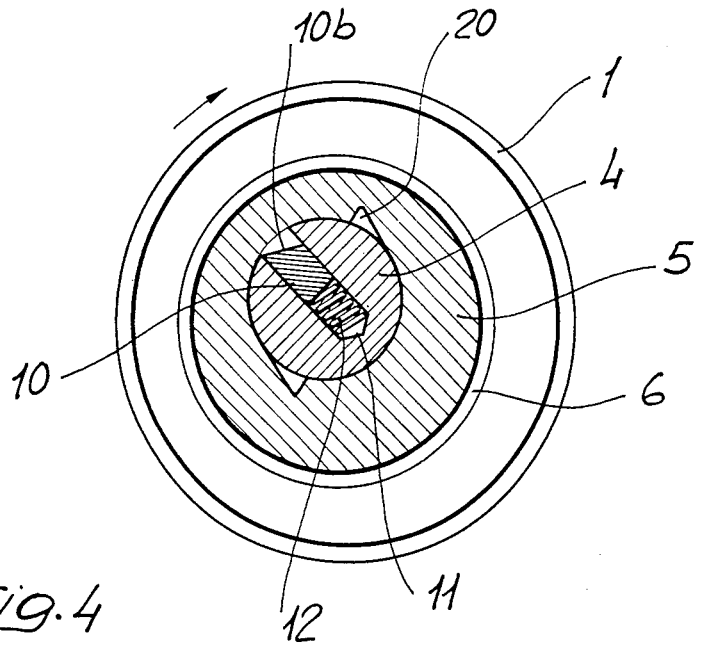
FIG. 4 is a schematic plan view similar to that of FIG. 3, showing the unit in an intermediate position between the two end positions.

The radially outer end of the pawl 10 which projects from the eccentric boss has an asymmetric shape with a first face 10*a* lying approximately radially of the boss 4 and an inclined face 10*b* lying at a shallow angle to a tangent to the circumference. Correspondingly, in the eccentric bush 5 which surrounds the eccentric boss 4, there is provided, in diametrically opposite positions, detents 20 having a shape which matches that of the end of the pawl, in such a way as to define a rotary coupling surface 20*a* and an inclined surface 20*b*. The detents 20 are diametrically oppositely positioned on the axis of eccentricity of the bush 4 in such a way as to define two distinct positions, namely a first or eccentric position as illustrated in FIG. 1, and a second or concentric position as illustrated in FIG. 3. In the first position of the mechanism the gear 1 and the big end ring 6 of the connecting rod 7 are coupled eccentrically, and in the second position they are effectively connected concentrically by the compensating effects of the opposite eccentricity of the boss 4 and the bush 5.

When the pedal mechanism 3 is turned in the normal or "forward" direction the rotation impressed on the gear and, consequently, on the eccentric body 4, is such that the coupling face 10*a* of the pawl 10 engages with the cooperating surface 20*a* of the detent 20 thereby forming a rotary coupling which also causes the bush to rotate.

By reversing the direction of rotation of the pedal mechanism 3 the direction of rotation of the gear 1 and of the eccentric boss 4 is reversed, with the consequent result that relative rotation of the eccentric boss 4 takes place with respect to the eccentric bush 5 so that the inclined surfaces 10*b* of the pawl 10 and 20*b* of the detent 20 contact one another and when the resilient biasing of the spring 12 is overcome the pawl 10 is pressed into the bore 11. This allows the utiliser quickly and easily to change the mechanism over from an eccentric to a concentric coupling position or vice versa simply by back-pedalling for half of one revolution. When the eccentric coupling is made the handle-bar is caused to perform synchronous oscillation or angular reciprocation by the movement of the pedal mechanism, which as normal is continuously rotated in the forward direction during use. On the other hand, when a concentric coupling is made the connecting rod 7 does not transmit any motion to the handle-bars, which therefore, remain in a fixed upright position.

Figure 5:
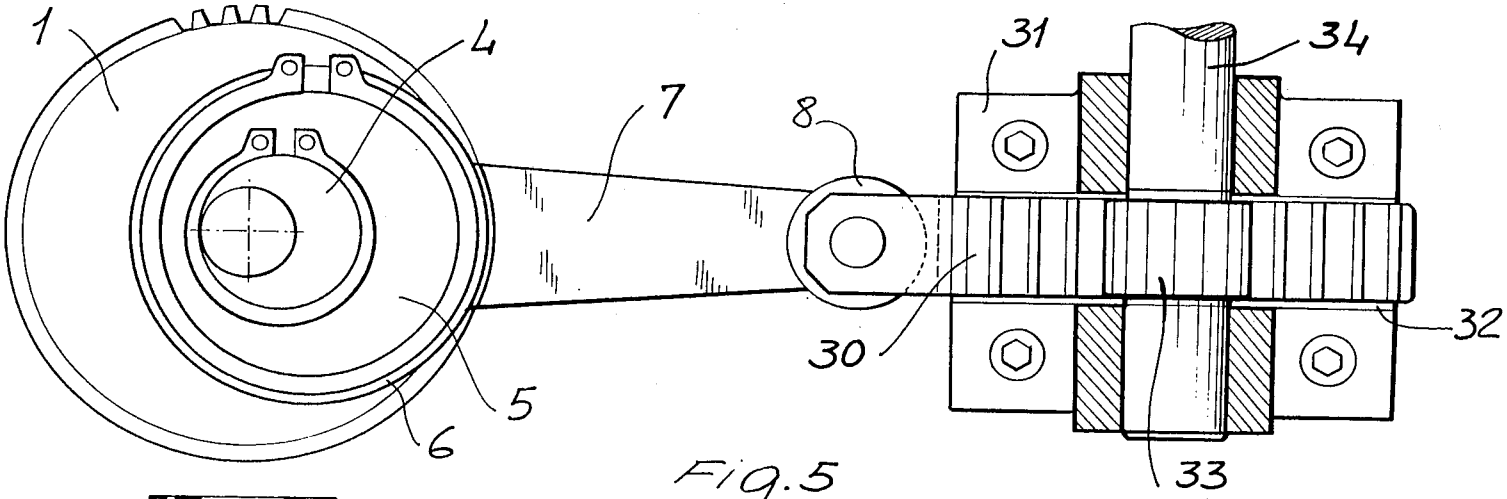
FIG. 5 represents the unit seen from above and partially in section, with the device for the reciprocating rotation of the handle-bar in evidence.
Figure 6:
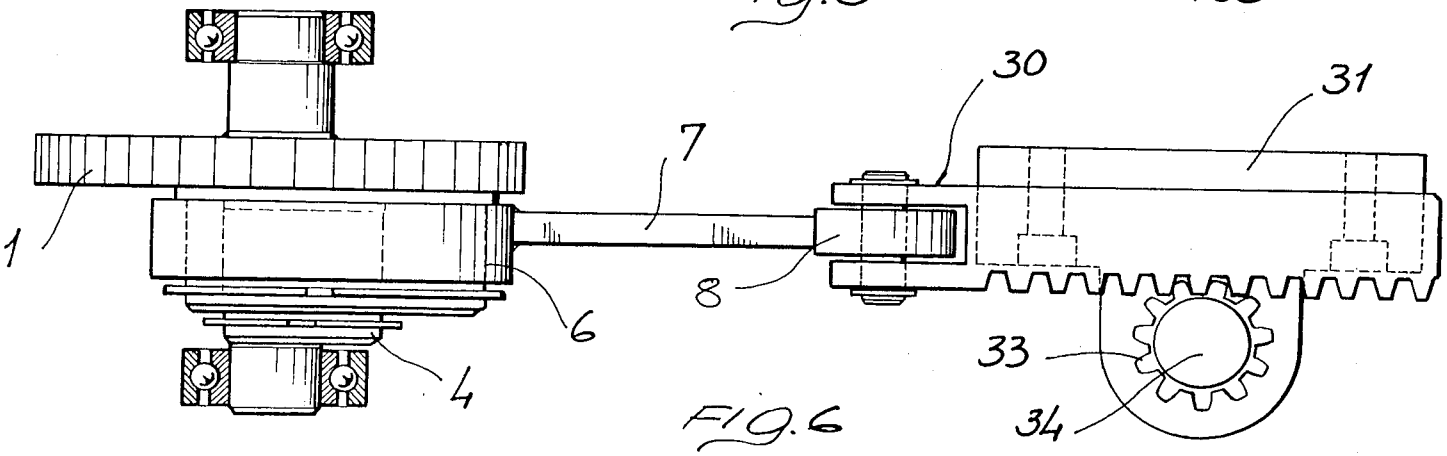
FIG. 6 represents, seen from above, the unit connected for reciprocating rotation of the handle-bars.

As is clearly illustrated in FIGS. 5 and 6 the handle-bar motion unit forming the subject of the invention also offers the possibility of obtaining reciprocating rotation of the handle-bars about an upright or approximately vertical axis. This result is obtained by means of a rack section 30 which is coupled pivotally to the connecting rod 7 and which is slidably guided in a guide block 31 which defines a sliding seat 32 in which a toothed pinion 33 is provided. This latter is fitted to the handle-bar column in such a way that the reciprocating motion impressed on the rack 30 by an eccentric coupling of the bush 5 causes a reciprocating rotation of the handle-bars, thus contributing to torsional motion of the trunk of a user which is very beneficial.

It will be appreciated that conversion from a fixed handle-bar position to a reciprocating motion position can be achieved simply by effecting a reverse rotation of the pedals because the ratchet mechanism described hereinabove permits the eccentricity of the coupling of the connecting rod which transmits the motion to the handle-bars to be cancelled or reinstated at will. Furthermore a new function has been added to the classic functions of an exercise bicycle in that there is now provided the possibility of an angular reciprocating motion of the handle-bars about the axis of the handle-bar column.

What is claimed is:

1. A handle-bar motion unit for an exericse bicycle, comprising a rotatable gear wheel rotatably supported by the frame of said exericse bicycle and having an eccentric boss projecting laterally therefrom, a toothed sprocket meshing with said rotatable gear wheel, said toothed sprocket being connected for rotation with a pedal mechanism of said exercise bicycle, a connecting rod for connecting said rotatable gear wheel with a pivoted handle-bar supporting column of said exercise bicycle, said connecting rod having a big end with a bush receiving opening and a little end opposite said big end, adapted for connection to said pivoted handle-bar support column, a bush in said bush receiving opening of said big end of said connecting rod, means defining an aperture in said bush, said bush aperture being eccentrically positioned in said bush, said bush being rotatable within said opening in said big end of said connecting rod, said eccentric boss of said gear wheel being received in said eccentric aperture of said bush, a ratchet mechanism interlinking said eccentric boss of said gear wheel and said bush, said ratchet mechanism operating to transmit rotary motion from said eccentric boss to said bush upon rotation of said boss in the forward direction and to allow relative rotation of said boss and said bush when said boss is rotated in the reverse direction whereby to displace said boss and said bush between a first operating position in which said big end of said connecting rod is positioned eccentrically with respect to said gear wheel and a second operating position in which the eccentricity of said boss and that of said bush couteract one another and said big end of said connecting rod is connected effectively concentrically of said gear wheel, said ratchet mechanism comprising a pawl lodged in a bore within said eccentric boss, a spring urging said pawl resiliently outwardly of said bore, said spring acting between said pawl and the bottom of said bore, the radially outer end of said pawl having a coupling face and an inclined face, the surface of said bush in contact with said eccentric boss having, at two diametrically opposite positions, detents the shape of which corresponds to that of said end of said pawl, said coupling surface of said pawl being engageable cooperatively with an abutment surface of said detent upon forward rotation of said pedal mechanism, wherein there is further provided a rack at the end of said connecting rod, said rack being slidably housed in a guide block which defines a sliding seat for said rack, a toothed pinion fitted on said handle-bar column and meshing with said rack whereby to effect reciprocating rotation of said handle-bar about a substantially upright axis when said bush and said boss arein said first operating position.

* * * * *